US006742960B2

(12) United States Patent
Corcoran et al.

(10) Patent No.: US 6,742,960 B2
(45) Date of Patent: Jun. 1, 2004

(54) VIBRATORY COMPACTOR AND METHOD OF USING SAME

(75) Inventors: Paul T. Corcoran, Washington, IL (US); Thomas J. Richards, Peoria, IL (US); George Codina, Gardena, CA (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/191,921

(22) Filed: Jul. 9, 2002

(65) Prior Publication Data

US 2004/0009039 A1 Jan. 15, 2004

(51) Int. Cl.[7] ..... E01C 19/38
(52) U.S. Cl. ..... 404/117; 404/122; 404/133.05
(58) Field of Search ..... 404/112, 115, 404/117, 133.05, 133.1, 133.2, 122, 124

(56) References Cited

U.S. PATENT DOCUMENTS

| | | | | |
|---|---|---|---|---|
| 3,849,986 A | * | 11/1974 | Vural | 60/537 |
| 3,856,426 A | * | 12/1974 | Waschulewski et al. | 404/133.1 |
| 3,909,147 A | | 9/1975 | Takata | |
| 3,909,148 A | * | 9/1975 | Vural et al. | 404/133.05 |
| 4,003,203 A | * | 1/1977 | Vural | 60/537 |
| 4,382,715 A | * | 5/1983 | Vural et al. | 404/133.05 |
| 4,481,835 A | | 11/1984 | Storm | |
| 4,493,585 A | * | 1/1985 | Axer | 404/102 |
| 5,397,198 A | | 3/1995 | Bertrand | |
| 5,934,245 A | | 8/1999 | Miller et al. | |
| 5,942,679 A | | 8/1999 | Sandström | |
| 6,268,667 B1 | | 7/2001 | Denne | |
| 6,293,729 B1 | | 9/2001 | Greppmair | |
| 6,322,287 B1 | | 11/2001 | Yelton | |
| 6,462,439 B1 | | 10/2002 | Denne | |

FOREIGN PATENT DOCUMENTS

JP 01295901 A * 11/1989 ..... E01C/19/38

* cited by examiner

*Primary Examiner*—Robert E. Pezzuto
*Assistant Examiner*—Alexandra K. Pechhold
(74) *Attorney, Agent, or Firm*—Liell & McNeil

(57) ABSTRACT

Vehicular and/or walk behind vibratory compactors utilize a vibrated roller or plate to impose compaction forces on a densifiable strata, such as ground soil, a roadway base material or pavement. Utilizing a rotating energy source, such as a engine or hydraulic motor, to create the vibration appears to have reached its limit in the ability to provide a wide range of vibration frequencies and amplitudes to satisfy the ever increasing demands placed on vibratory compactors. Instead of relying upon rotational energy, the present invention contemplates the use of a linear oscillator to produce the vibrations, and preferably utilizes at least one electromagnet to control the frequency(s) and amplitude(s) of a compacting vibration. The present invention finds potential application in a wide range of vibratory compactors, including walk behind models that utilize a plate and larger vehicular models that include one or more vibrating rollers.

18 Claims, 2 Drawing Sheets

VIBRATORY COMPACTOR AND METHOD OF USING SAME

TECHNICAL FIELD

This invention relates generally to vibratory compactors, and more particularly to the usage of a linear actuator to vibrate the surface contacting member of a vibratory compactor.

BACKGROUND

Vibratory compactors typically comprise a plate or roller that is oscillated or vibrated to impose compaction forces on a densifiable strata, such as ground soil, roadway base material, or paving material. In most instances, an engine or hydraulic motor controllably rotates at least one eccentric mass to impart vibratory motion at a particular frequency to the surface contacting plate or roller member. The result is an oscillatory force with the frequency of the speed of rotation, and an amplitude dependent on the mass eccentricity and speed of rotation. Variations on this basic system include multiple eccentric weights and/or shafts such that by changing the phasing of the multiple weights and/or shafts, the degree of force created by the eccentric masses can be varied. For instance, U.S. Pat. No. 3,909,147 to Takata teaches a variable amplitude vibration generator for a compactor.

Although these systems have proven effective, there remains room for improvement. Current rotating eccentric mass systems often have a limited range of available frequencies and amplitudes, and more often this range is limited to a few discrete frequencies. More recently, engineers have observed that, depending upon the particular conditions, the compaction process can be substantially improved and/or hastened by having the ability to adjust the vibration frequency and/or amplitude to suit the particular conditions. U.S. Pat. No. 5,942,679 to Sandstrom discusses some of these issues.

In addition, paving compaction machines are now facing new challenges due to the introduction of so called "superpavers". These new paving compounds often require a higher rate of compaction because they must be compacted within a narrow compound temperature range. This can dictate the requirement that the compactor either be more efficient in compacting the strata and/or have the ability to effectively compact while moving faster. In addition, these new superpavers can sometimes have aggregates that make them harder to compact. In order to meet these demands, a next generation of vibrating compactors needs to operate more efficiently and be equipped to provide a larger variety of vibration frequencies and amplitudes. These improvements need to be accompanied by improved reliability at a competitive cost.

One alternative method of generating vibrations without reliance upon a rotating eccentric mass is disclosed in U.S. Pat. No. 6,293,729 to Greppmair. That reference teaches a walk behind compactor for compacting soil that includes an internal combustion engine that is coupled to drive a working mass linearly up and down via a crank mechanism and spring assembly. This reference also teaches the idea of reciprocating a counter mass out of phase with the working mass, presumably to reduce the amount of vibration transferred to the user via the compactor framework. Although the Greppmair compactor diverges from earlier compactors in its use of a linearly displaced working mass, it retains many of the drawbacks associated with earlier vibratory compactor strategies that rely upon a rotating shaft driven by an engine or other motor to supply the motion and energy for producing the compacting vibration.

The present invention is directed to one or more of the problems set forth above.

SUMMARY OF THE INVENTION

In one aspect, a compactor includes a surface contacting member attached to a chassis. A linear oscillator is operably coupled to vibrate the surface contacting member. The linear oscillator includes at least one electromagnetic force generator.

In another aspect, a compactor includes a first roller and a second roller that are rotatably attached to a chassis. A first linear oscillator is operably coupled to vibrate the first roller, and a second linear oscillator is operably coupled to vibrate the second roller.

In still another aspect, a method of compacting a stratum includes a step of vibrating a surface contact member of a compactor. The vibrating step includes a step of actuating a linear oscillator operably coupled to vibrate the surface contacting member. The actuating step includes a step of energizing at least one electromagnet.

DETAILED DESCRIPTION

Figure 1:
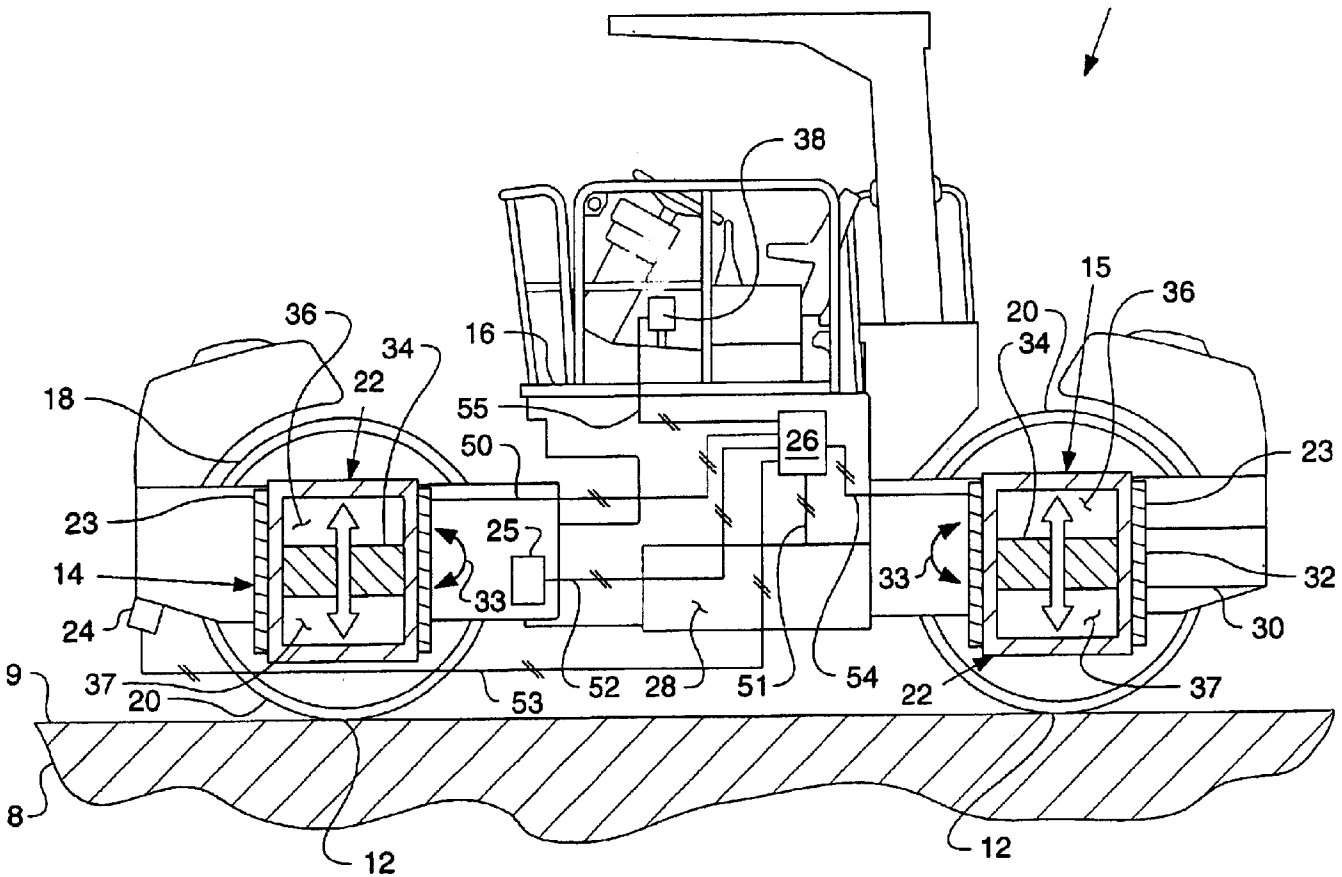
FIG. 1 is a schematic side view of a compactor according to one embodiment of the present invention.

Referring to FIG. 1, a compactor 10 is shown compacting a stratum 8, which in a typical example could include a layer of freshly laid pavement 9. Compactor 10 includes surface contacting members 12 in the form of a first roller 18 and second roller 20 attached to a chassis 16 in a conventional manner. First roller 18 is vibrated by a first linear oscillator 14, and second roller 20 is vibrated by a second linear oscillator 15. Linear oscillators 14, 15 each preferably include an electromagnetic force generator 22 that includes at least one electromagnet 23. Electromagnetic force generators 22 can have any suitable structure, but are preferably of a type generally described in U.S. Pat. No. 6,268,667 to Denne. In other words, the electromagnetic force generators preferably include an outer member with a plurality of stacked electromagnetic coils or a helical electromagnetic coil arrangement, and an inner member that moves along a line corresponding to the center of the coils with respect to the outer member. The inner member may include a plurality of stacked permanent magnets or a similar helical arrangement of electromagnets that interact with electromagnetic coils in the outer member to produce a force in either direction along the centerline of the coils. The coils can be arranged to be connected to a conventional multi phase motor drive, which in the illustrated example would be controlled by an electronic control module 26 equipped with an appropriate oscillator control algorithm. Although the linear oscillators 14, 15 of the present invention preferably include at least one electromagnet 23, those skilled in the art will appreciate that other suitable linear oscillators could be employed, such as a free piston internal combustion engine, as in that disclosed in U.S. Pat. No. 5,934,245 to Miller et al. In such an alternative embodiment, the oscillation (vibration) could also be controlled by utilizing electronically controlled fuel injectors of a type well known in the art.

In the illustrated embodiment, each electromagnetic force generator 22 is operably coupled to its respective roller 18, 20 in a conventional manner, such as by being attached to a roller axle. Each electromagnetic force generator 22 includes a housing 32 that includes at least one electromagnet 23. Electromagnet(s) 23 is operably coupled to a moveable mass 34 that is restricted to moving along a line as shown by the double headed arrow in the illustration. Moveable mass 34 preferably includes at least one permanent magnet or electromagnet that are orientable in opposition to the electromagnet(s) 23 in housing 32 generate a force along the line when the electromagnet(s) is energized. This type of apparatus for producing linear motion is described generally in U.S. Pat. No. 6,268,667 to Denne, but could equally well be any other type of electromagnetic linear force generator. The moveable mass 34 can be supported in housing 32 by one or more springs 36, 37. Springs 36, 37 can be mechanical or any other suitable type of spring, such as a fluid spring, which could utilize a liquid and/or a gas. Each linear oscillator 14, 15 also preferably includes an orientation adjuster 33 that allows the line of the linear oscillator to be adjusted off the vertical, as shown. Those skilled in the art will appreciate that compaction can occur over a range of angles that relate to the radius of rollers 18, 20. In addition, the most effective compacting may occur with particular amplitudes and frequencies that are off the vertical.

Each linear oscillator 14, 15 is operably coupled to a controller 38 via an electronic control module 26. In the illustrated embodiment, controller 38 is available to the operator of compactor 10, and could include options such as:

1) an on/off switch for the vibration system;
2) a switch between synchronous or asynchronous vibrations between respective linear oscillators 14, 15;
3) a manual or automatic vibration control switch;
4) a manual vibration frequency control;
5) a manual vibration amplitude control; and
6) separate orientation controls for the two linear oscillators.

Those skilled in the art will appreciate that controller 38 could include any other suitable operator controllable aspect relating to the compacting vibrations produced by compactor 10. Control command signals from controller 38 are forwarded to electronic control module 26 via a communication line 55 in a conventional manner.

In the illustrated embodiment, electronic control module 26 also preferably receives sensor signals from sensors 24 and 25 via communication lines 53 and 52, respectively. Sensors 24, 25 could be any suitable sensor including but not limited to ground probing radar, an accelerometer, troxler sensors, etc. Electronic control module 26 preferably interprets these sensor signals and the operator control signal(s), and produces control signals that are delivered to linear oscillators 14, 16 to energize electromagnet(s) 23 in a particular pattern to produce a desired vibration frequency, amplitude, orientation and phase. These signals are communicated to linear oscillators 14, 15 in a conventional manner via communication lines 50 and 54, respectively.

Although compactor 10 could be propelled over the ground in any suitable manner, it preferably includes an electric propulsion unit 30 that receives electrical energy from a generator set 28 mounted on chassis 16. Generator set 28 would also provide the electrical energy necessary to operate linear oscillators 14, 15. Such an all electric strategy could permit the engine portion of generator set 28 to be substantially reduced in size and possibly in sophistication, while retaining the ability to supply the necessary energy to operate all aspects of compactor 10. Electronic control module 26 communicates with generator set 28, either by way of control signals and/or feedback signals, via a communication line 51 in a conventional manner.

Figure 2:
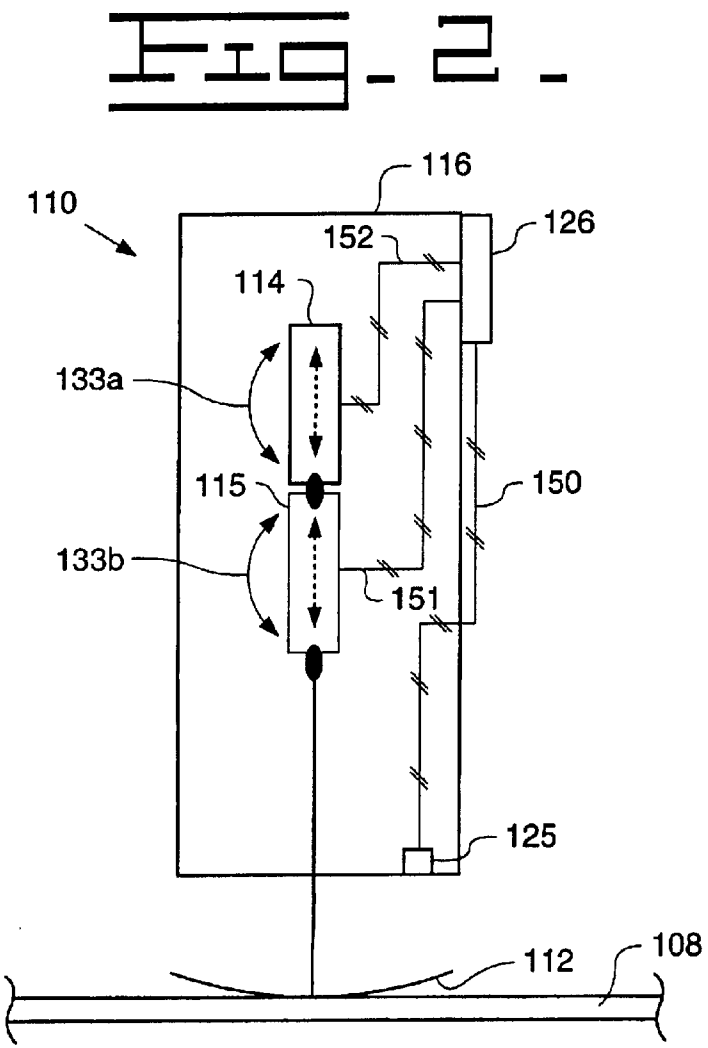
FIG. 2 is a partial schematic illustration of a compactor according to another aspect of the present invention.

Referring now to FIG. 2, a schematically illustrated compactor 110 according to another aspect of the present invention includes a pair of linear oscillators 114, 115 operably coupled to vibrate a surface contacting member 112. Recalling that FIG. 1 shows each surface contacting member operably coupled to a single linear oscillator. Each of the linear oscillators 114, 115 could include electromagnetic force generators of the type previously described in relation to FIG. 1. The linear oscillators 114, 115 are suitably mounted on a chassis 116, which could be that of a walk behind compactor or one of many types of vehicular chassis known in the art. In addition, ground surface contacting member 112 could represent a portion of a roller or could represent a plate, in the case of vibratory compactors including a vibrating plate. Linear oscillators 114, 115 also preferably include separate orientation adjusters 133*a, b* that allow each linear oscillator to be independently oriented with respect to surface contacting member 112. The operation of linear oscillators 114, 115 are preferably controlled via an electronic control module 126 via communication lines 152, 151, as previously described. These control signals are preferably but not necessarily influenced by sensor signals received by electronic control module 126 from sensor 125 via a conventional communication line 150. Those skilled in the art will appreciate that, although linear oscillators 114, 115 have been shown in series, they can also be operably oriented in parallel without departing from the present invention. By having two linear oscillators 114, 115 associated with each surface contacting member 112, compound vibrations having potentially two or more different frequencies and amplitudes, and phases could be produced. In addition, the two linear oscillators 114, 115 could be oriented at different angles to produce vibrations along different lines that may deviate from the vertical. In a preferred strategy of utilizing the structure shown in FIG. 2, the two linear oscillators 114, 115 would be substituted in place of one of the linear oscillators shown in FIG. 1, and might each have an operational energy on the order of about one half of the linear oscillator shown in FIG. 1. Such a strategy would allow the two linear oscillators to be quickly put into or out of phase to quickly maximize a vibration or just as quickly cancel a vibration, such as when the compactor 10 comes to a stop. In other words, one aspect of electronic control module 126 control algorithm may be to adjust the relative phase of the two linear oscillators to avoid over compaction when the compactor is not moving. Compactor 110 is shown compacting a stratum 108, which could be, for example, freshly laid pavement or possibly a layer of gravel.

Figure 3:
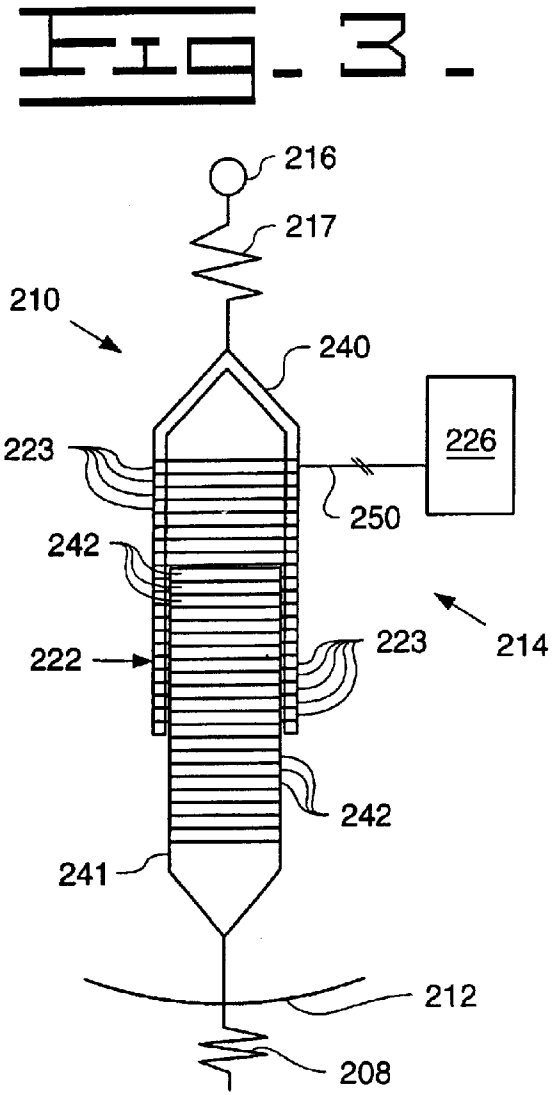
FIG. 3 is a partial schematic illustration of a compactor according to still another aspect of the present invention.

Referring now to FIG. 3, a schematic illustration of a compactor 210 according to still another aspect of the present invention is illustrated. In this example, the linear oscillator 214 is operably coupled directly between the surface contacting member 212 and the vehicle suspension 217. In this example, the stratum 208 being compacted is exploited for its spring effect, while the force produced by electromagnetic force generator 222 acts against the inertia of chassis 216, as transmitted via vehicle suspension 217. In this embodiment, linear oscillator 214 is much like that described in FIG. 1, but instead of having a moveable mass, the device includes a telescoping outer tube 240 with an inner tube 241. The outer tube 240 includes a plurality of stacked electromagnetic coils 23 that are controlled in their energization by an electronic control module 226 via a communication line 250. The inner tube 241 preferably includes a plurality of stacked ring shaped permanent magnets that interact with electromagnet(s) 223 to produce a force pushing the tubes 240, 241 away from one another or toward one another, depending upon the energization magnitude, sequence or pattern. This embodiment might also include a known means for adjusting the stiffness of vehicle suspension 217, in order to influence the nature of the vibration transmitted to the stratum 208 by compactor 210. The linear oscillator structure 214 shown in FIG. 3 could also be substituted in place of the linear oscillators 14, 15 shown in FIG. 1.

Industrial Applicability

The present invention finds potential application across the line of vibratory compactors that are used for compacting a variety of strata. This includes plate vibrating walk behind models with no means of propulsion up to and including large dual roller compactors of the class generally shown in FIG. 1. The present invention seeks to address problems in the art associated with reliance upon a rotating shaft from a motor or engine to create a vibration intended to be directed in a particular direction. The present invention relies upon a linear oscillator to produce a vibration that is preferably both parallel and co-linear with the axis of the linear oscillator. Although the linear oscillator of the present invention could take on any suitable structure, including the possibility of a free piston internal combustion engine, it preferably includes at least one electromagnetic force generator. Preferably, the present invention utilizes a so called "free piston turbo-ram" of a type generally described by Advanced Motion Technology, of Aston, Md.

When in operation, electromagnetic force generator 22, includes at least one armature (working mass 34) within a housing 32 that includes a plurality of electromagnetic coils 23. This electromagnetic force generator is used to create a linear dynamic force by exciting the moveable mass 34 to oscillate within the housing 32. springs 36 and 37 at each end of the housing, which could be gas, liquid, elastomeric or metallic springs to absorb and return energy to the moveable mass 34 during direction change at each end of the mass's motion. Preferably, the electromagnetic force generator is attached to the axle of the compactor rollers or to the structure supporting the bearings for the rollers to provide transmission of the dynamic force emanating from the actuator into the compactor rollers, and thereby into the stratum via the ground surface. In enhanced versions, the present invention also contemplates varying the rate of oscillation to vary the frequency of the dynamic force, and varying the length of the oscillation to vary the amplitude of the dynamic force of the vibration. In addition, these parameters could be varied either manually or automatically in a closed loop manner to match the dynamic force to ground conditions as determined by one or more sensors. In addition, frequency and amplitude of the dynamic force during the compaction process could be varied in real time, and possibly each roller independently to increase the compaction efficiency for any particular ground condition. With regard to the particular linear oscillators, various sizes and masses of the moveable mass could be used to match the frequency and amplitude of the dynamic force to the desired machine parameters. For instance, the linear oscillators would preferably have a range of available frequencies that all exceed the natural frequency of the compactor itself.

Preferably, the machine and linear oscillator would be tuned with respect with one another to provide steplessly controlled variable frequency and amplitude over a wide range of effective compacting waveforms. In addition, the present invention also contemplates the ability to provide complex vibration wave shapes to achieve a particular purpose. For instance, it might be desirable to have a strong down force component to the vibration but a relatively relaxed return force to avoid compactor bouncing where the roller can leave the surface of the stratum. In the illustrated embodiments, the present invention has been shown implemented with two different electromagnetic strategies. In the one shown in FIG. 1, the previous rotating eccentric mass vibrator has been directly replaced with an electromagnetic force generator. In the second example, best illustrated in FIG. 3, the design-of the machine/electromagnetic force generator/roller is combined as a highly powerful and efficient electromagnetic actuator.

In one sense, the present invention contemplates a method of compacting a stratum by vibrating a surface contacting member of a compactor. The surface contact member is operably coupled to a linear oscillator that is actuated by energizing at least one electromagnet. This basic methodology can include a number of enhancements. For instance, in the case of surface contacting member operably coupled to two separate linear oscillators, the two linear oscillators can be placed 180° out of phase to cancel the vibration. Such a strategy, for instance, could be advantageous in roller type compactors when they are not moving. In other words, the two linear oscillators would automatically go 180° out of phase when the compactor came to rest to avoid creation of dips in the stratum being compacted. In addition, this same capability would allow for the creation of complex waveforms to achieve some particular purpose. For instance, it might be desirable to have a relatively fast downward vibration force followed by a relatively gradual return force in order to avoid compactor bouncing where a roller can actually lose contact with the surface of the stratum. Preferably, the linear oscillator(s) could be operated in a manner such that the vibration is formed at a plurality of superimposed frequencies. This can be accomplished by actuating a linear oscillator at a first frequency, phase and amplitude, while simultaneously actuating a second linear oscillator at a second frequency, phase and amplitude. In the preferred version, the operation of the linear oscillators is preferably controlled by an electronic control module. The electronic control module would have a control algorithm that could include preprogrammed maps for vibration frequencies that could be called upon to operate the compactor in an open loop fashion. The electronic control module could be operably coupled to manual controls and merely operate to convert those manual commands into suitable commands for the linear oscillators. Or it could operate in a closed loop fashion using sensors to sense a ground condition and adjust the vibration(s) in one or both rollers to improve compaction efficiency or achieve some other aim. In other words, the vibrations are preferably controlled at least in part by determining at least one of the vibration frequency, a vibration phase and a vibration amplitude based at least in part on a sensed condition. Furthermore, the various features that influence what vibration frequencies and amplitudes are available are preferably such that the linear oscillator can be operated in a manner that allows for steplessly changing at least one of the vibration frequency and vibration amplitude over some suitable range. In addition, the electromagnetic force generator preferably includes orientation adjusters that allow the line of the vibration to be adjusted away from the vertical, if desired. When two such linear oscillators are independently adjustable with regard to orientation, the nature of the vibration can be made even more complex, such as operating along more than one line at different frequencies and amplitudes.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. A compactor comprising:

a chassis;

a surface contacting member attached to said chassis;

a linear oscillator including at least one electromagnetic force generator operably coupled to vibrate said surface contacting member; and said surface contacting member includes a roller.

2. The compactor of claim 1 wherein said linear oscillator has a plurality of orientations with respect to said surface contacting member.

3. A compactor comprising:

a chassis;

a surface contacting member attached to said chassis;

a linear oscillator including at least one electromagnetic force generator operably coupled to vibrate said surface contacting member; and said linear oscillator is a first linear oscillator; and a second linear oscillator operably coupled to vibrate said surface contacting member.

4. The compactor of claim 3 including separate controllers for said first linear oscillator and said second linear oscillator.

5. A compactor comprising:

a chassis;

a surface contacting member attached to said chassis;

a linear oscillator operably coupled to vibrate said surface contacting member;

said linear oscillator including at least one electromagnetic force generator;

an electronic control module in control communication with said linear oscillator;

a sensor in communication with said electronic control module and producing a sensor signal; and said electronic control module includes an oscillator control algorithm that includes said sensor signal.

6. A compactor comprising:

a chassis;

a surface contacting member attached to said chassis;

a linear oscillator including at least one electromagnetic force generator operably coupled to vibrate said surface contacting member; and said linear oscillator includes a housing, a movable mass, an electromagnetic actuator operably coupled to said movable mass, and at least one spring operably positioned between said housing and said movable mass.

7. A compactor comprising:

a chassis;

a surface contacting member attached to said chassis;

a linear oscillator including at least one electromagnetic force generator operably coupled to vibrate said surface contacting member; and an electronic control module in control communication with said linear oscillator;

a sensor in communication with said electronic control module and producing a sensor signal;

with electronic control module includes an oscillator control algorithm that includes said sensor signal;

said linear oscillator has a plurality of orientations with respect to said surface contacting member; and said surface contacting member includes a roller.

8. A compactor comprising:

a chassis;

a first roller rotatably attached to said chassis;

a second roller rotatably attached to said chassis;

a first linear oscillator operably coupled to vibrate said first roller;

a second linear oscillator operably coupled to vibrate said second roller; and an electronic control module mounted on said chassis in control communication with at least one of said first linear oscillator and said second linear oscillator, and including an oscillator, and including an oscillator control algorithm.

9. The compactor of claim 8 wherein said first linear oscillator includes at least one electromagnetic force generator operably coupled to vibrate said first roller; and said second linear oscillator includes at least one electromagnetic force generator operably coupled to vibrate said second roller.

10. The compactor of claim 8 including separate controllers for said first linear oscillator and said second linear oscillator.

11. The compactor of claim 8 including said electronic control module in control communication with both said first linear oscillator and said second linear oscillator.

12. The compactor of claim 8 wherein said first linear oscillator includes at least one electromagnetic force generator operably coupled to vibrate said first roller;

said second linear oscillator includes at least one electromagnetic force generator operably coupled to vibrate said second roller;

an electronic control module in control communication with said first linear oscillator and said second linear oscillator, and including separate controllers for said first linear oscillator and said second linear oscillator.

13. A compactor comprising:

a chassis;

a first roller rotatably attached to said chassis;

a second roller rotatably attached to said chassis;

a first linear oscillator operably coupled to vibrate said first roller;

a second linear oscillator operably coupled to vibrate said second roller;

an electronic control module in control communication with said first linear oscillator and said second linear oscillator;

at least one sensor in communication with said electronic control module and producing a sensor signal; and said electronic control module includes an oscillator control algorithm that includes said sensor signal.

14. A method of compacting a stratum, comprising the steps of: vibrating a surface contact member of a compactor; said vibrating step includes a step of actuating a linear oscillator;

said actuating step includes a step of energizing at least one electromagnet operably coupled to vibrate said surface contact member; and reducing vibration of said surface contacting member at least in part by actuating a first linear oscillator out of phase with a second linear oscillator.

15. A method of compacting a stratum, comprising the steps of: vibrating a surface contact member of a compactor: said vibrating step includes a step of actuating a linear oscillator;

said actuating step includes a step of energizing at least one electromagnet operably coupled to vibrate said surface contact member; and said vibrating step is performed at a plurality of superimposed frequencies at least in part by actuating a first linear oscillator at a first frequency, phase and amplitude, and actuating a second linear oscillator at a second frequency, phase and amplitude.

16. The method of claim 15 including a step of controlling actuation of said linear actuator with an electronic control module.

17. A method of compacting a stratum, comprising the steps of: vibrating a surface contact member of a compactor;

said vibrating step includes a step of actuating a linear oscillator operably coupled to vibrate said surface contact member; and said actuating step includes a step of energizing at least one electromagnet;

said vibrating step is performed at a plurality of superimposed frequencies at least in part by actuating a first linear oscillator at a first frequency, phase and amplitude, and actuating a second linear oscillator at a second frequency, phase and amplitude;

controlling actuation of said linear actuator with an electronic control module;

sensing a condition; and said controlling step includes a step of determining at least one of vibration frequency, vibration phase and vibration amplitude based at least in part on the sensed condition.

18. The method of claim 17 including a step of steplessly varying at least one a vibration frequency and a vibration amplitude.

* * * * *